US005560721A

United States Patent [19]

Hirota et al.

[11] Patent Number: 5,560,721

[45] Date of Patent: Oct. 1, 1996

[54] SHUTTLE PRINTER WITH SHIFTING WIRE GUIDES

[75] Inventors: Atsushi Hirota, Nagoya; Atsuo Sakaida, Gifu, both of Japan

[73] Assignee: Brother Kogyo Kabushiki Kaisha, Nagoya, Japan

[21] Appl. No.: 357,922

[22] Filed: Dec. 16, 1994

[30] Foreign Application Priority Data

Dec. 24, 1993 [JP] Japan ..... 5-347879

[51] Int. Cl.[6] ..... B41J 2/265

[52] U.S. Cl. ..... 400/124.27; 101/93.05

[58] Field of Search ..... 400/124.27, 124.24, 400/124 GT, 124 VI; 19/93.05

[56] References Cited

U.S. PATENT DOCUMENTS

| | | | |
|---|---|---|---|
| 2,802,414 | 8/1957 | Johnson | 400/124.27 |
| 3,318,429 | 5/1967 | Burns et al. | 400/124.27 |
| 3,882,985 | 5/1975 | Liles | 400/124.27 |
| 4,077,336 | 3/1978 | Talvard et al. | 400/124.27 |

FOREIGN PATENT DOCUMENTS

| | | | |
|---|---|---|---|
| 55-009853 | 1/1980 | Japan | 101/93.05 |
| 55-037366 | 3/1980 | Japan | 101/93.05 |

*Primary Examiner*—David A. Wiecking
*Attorney, Agent, or Firm*—Oliff & Berridge

[57] ABSTRACT

A shuttle printer has a flexible arm made of a resilient member, to which tip guides are fixed. Print wires driven by a plurality of piezoelectric actuators are supported by the flexible arm. Midway guides are provided to support and guide the intermediate portions of the print wires. The tip guides guide and support the tip ends of the print wires. The tip guides and the midway guides are rotatably supported by the flexible arm. When the tip guides are reciprocated in the lateral direction thereof by a reciprocating mechanism, the resilient arm is also driven to swing. Therefore, printing is carried out while a pair of resilient members of the flexible arm are elastically deformed in the lateral direction.

22 Claims, 13 Drawing Sheets

SHUTTLE PRINTER WITH SHIFTING WIRE GUIDES

BACKGROUND OF THE INVENTION

1. Field of the Invention

This invention relates to a shuttle printer and, more particularly, to a shuttle printer having an improved wire guide mechanism for guiding and supporting a plurality of print wires.

2. Description of the Related Art

One type of a shuttle printer is a wire dot type line printer. This type of printer is provided with a plurality of print wires horizontally arranged at predetermined intervals in the lengthwise direction of a platen with the tip ends thereof facing to the platen. A plurality of actuators are provided for respectively driving the print wires. A tip guide guides and supports the tip ends of the print wires, and a reciprocating mechanism reciprocates the tip guide over a fixed range in the lengthwise direction of the platen. This type of shuttle printer allows printing to be carried out at high speed while the tip guide is reciprocated. In the shuttle printer, the print wires are elastically deformed by reciprocating the tip ends of the print wires in the lateral direction (the lengthwise direction of the platen) by the tip guide. Hence, a certain length is required for the print wire.

A conventional shuttle printer disclosed in Japanese Patent Publication No. 59-13991 has a construction wherein a plurality of print wires are respectively guided by cylindrical wire holding links. Rear wire guides at the rear ends of the wire holding links are supported by a frame in a swingable fashion, and front wire guides at the front ends of the wire holding links are swingably supported in guide holes formed in a shuttle bar.

Another shuttle printer is also disclosed in Japanese Utility Model Publication No. 57-56865. This shuttle printer is provided with a pair of support springs extending from the right and left ends of a front guide (a tip guide) toward the direction opposite to a platen. The opposite ends of the support springs relative to the platen are fitted to a frame to be slidable in the lengthwise direction of print wires.

In the shuttle printer disclosed in Japanese Patent Publication No. 59-13991, each print wire is arranged to be inserted into the cylindrical wire holding link. Hence, the print wire can be appropriately guided. However, there is an increase in the number of parts, such as the wire holding links, rear wire guides and front wire guides. This makes the construction of the shuttle printer complicated. Further, the abrasion of a support section that swingably supports the wire guides may result in a reduced durability of the printer.

On the other hand, in the shuttle printer disclosed in Japanese Utility Model Publication No. 57-56865, the base end of each print wire is coupled to an actuator, and the front end of each print wire is guided and supported by the front guide. However, since the front guide is not formed to support and guide the midway portion of each print wire in the longitudinal direction thereof, each print wire is likely to be elastically deformed in a direction orthogonal to the lengthwise direction of the wire.

For these reasons there arise problems that a print driving force caused by the actuators is absorbed by the elastic deformation of the print wires. So, the print driving force weakens. Also, an increase in stress developed in the print wire by elastic deformation results in metal fatigue and, therefore, leads to the reduced durability of the print wires, causing problems such as broken print wires.

SUMMARY OF THE INVENTION

It is therefore an object of the present invention to provide a shuttle printer having improved printing performance and print wire durability in which midway portions of print wires, leading from actuators to a front end guide, are appropriately guided and supported by simple midway guides.

To this end, according to the first aspect of the present invention, a shuttle printer is provided with a plurality of print wires laterally arranged at predetermined intervals with the tip ends thereof facing a platen. A plurality of actuators respectively drive the print wires, and tip guides guide and support the tip ends of the print wires. A reciprocating mechanism reciprocates the tip guides in the lateral direction. The shuttle printer further comprises a gate-shaped flexible arm including an end member to which the tip guides are fixed. A pair of right and left resilient members are respectively fixed to the right and left ends of the end member and, at the other ends thereof, to a static member of a frame of the printer extending in a direction opposite to the platen. A midway guide is laterally arranged to guide and support the print wires on the opposite side of the platen with respect to the tip guides. Both ends of the midway guide are coupled to the resilient members of the flexible arm in such a way that the midway guide is rotatable on the axis orthogonal to a swinging plane in which the tip guides are reciprocated.

In a preferred mode, a plurality of midway guides may be provided at predetermined intervals in the lengthwise direction of the print wires. In another preferred mode, each of the midway guides may be formed of a first guide member that has a plurality of guide channels for respectively guiding the print wires and is positioned on one side of the print wires. A second guide member has a plurality of engagement sections to be respectively fitted into the guide channels and is positioned on the other side of the plurality of print wires to come into contact with the first guide member.

In the shuttle printer according to the first aspect of the present invention, the plurality of print wires are laterally arranged at predetermined intervals, and the tip end of each print wire faces the platen. Each print wire is driven by the actuator, and the tip ends of the print wires are guided and supported by the tip guides. The tip guides are laterally reciprocated by the reciprocating means.

When the tip guides are laterally reciprocated, the right and left resilient members are elastically deformed. However, both ends of the midway guide are coupled to be rotatable on the axis orthogonal to the swinging plane of the tip guides. Hence, the midway guide does not resist the elastic deformation of the resilient members.

The plurality of print wires are guided and supported between the tip guides and the actuators. Hence, the elastic deformation of the print wires in a direction orthogonal to the lengthwise direction of the wires is effectively suppressed.

In the shuttle printer according to the second aspect of the present invention, the plurality of midway guides are provided at predetermined intervals in the lengthwise direction of the print wires. Hence, the elastic deformation of the print wires in the direction orthogonal to the lengthwise direction of the wires can be effectively suppressed to a much greater extent.

In the shuttle printer according to the third aspect of the present invention, each of the midway guides is formed of the first guide member, which has a plurality of guide channels for respectively guiding the print wires and is positioned on one side of the print wires, and the second guide member, which has a plurality of engagement sections respectively fitted into the guide channels and is positioned on the other side of the print wires to come into contact with the first member. Since the midway guide is constructed such that the engagement sections are fitted into the guide channels, the assembly of the print wires and the midway guides is facilitated.

DETAILED DESCRIPTION OF PREFERRED EMBODIMENTS

Figure 1:
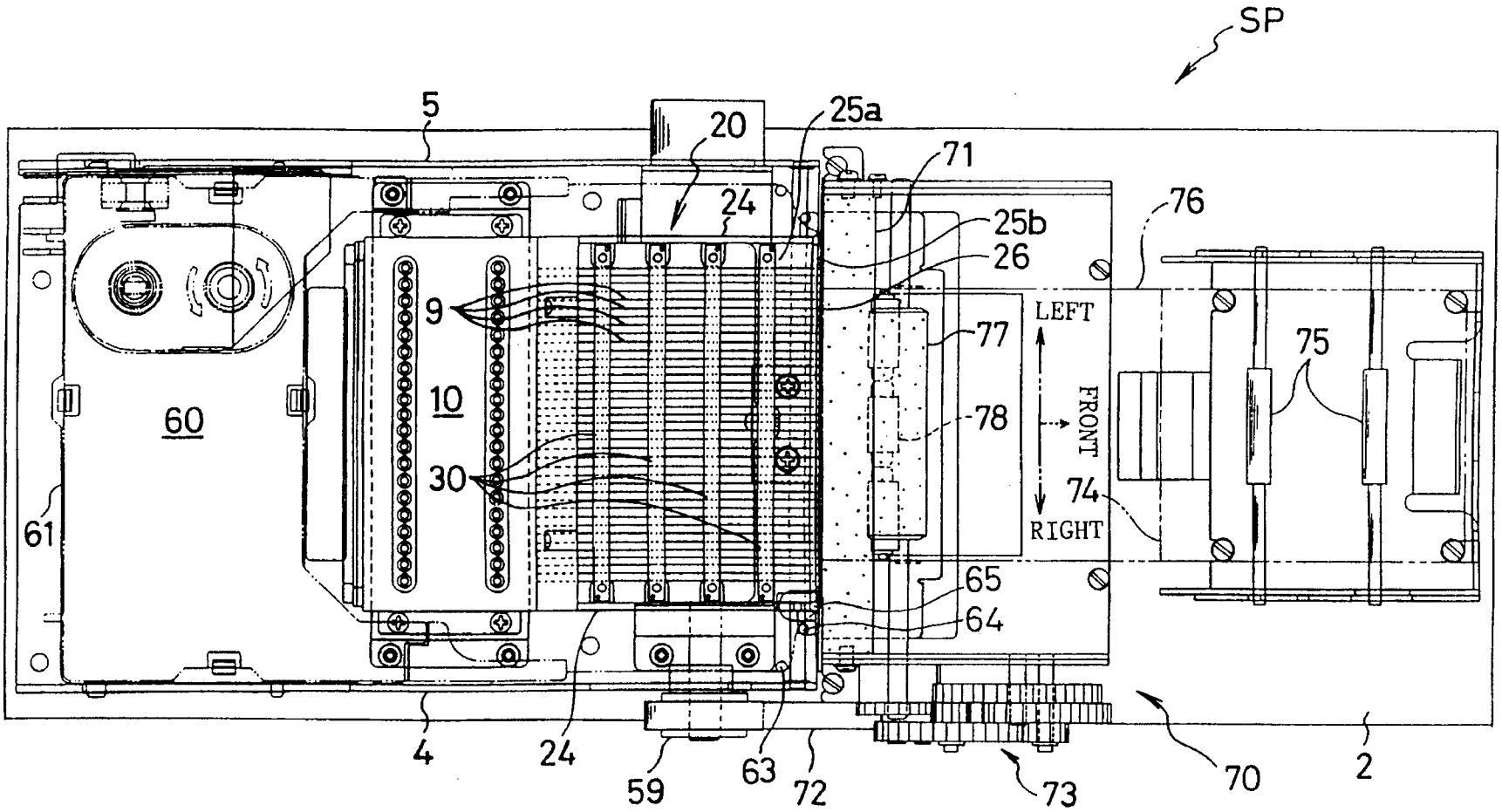
FIG. 1 is a schematic plan view showing a shuttle printer in a preferred embodiment according to the present invention.

Referring to FIGS. 1 through 15, a preferred embodiment of the present invention is described below. This embodiment is one example in which the present invention is applied to a wire dot type shuttle printer having 39 print wires. Of course, this invention can be applied to any type of wire dot printer having different configurations and numbers of wires. Incidentally, in this embodiment, the right and left directions and the front are defined by arrows in FIG. 1.

As shown in FIGS. 1 through 4, the shuttle printer SP comprises 39 print wires 9 (9*a*, 9*b*) arranged at predetermined intervals in the lateral direction. The wires 9 are coupled to an actuator unit 10 containing 39 piezoelectric actuators 11 (11*a*, 11*b*) for respectively driving the 39 print wires 9. A wire guide mechanism 20 guides and supports the 39 print wires 9. A reciprocating mechanism 50 reciprocates the tip ends of the 39 print wires 9 on a fixed stroke in the lateral direction. The shuttle printer SP also includes a ribbon supplying mechanism 60 containing a print ribbon cassette 61, and a paper feed mechanism 70 containing a platen 71. A housing plate 2 functions as a base member to which the previously mentioned various members and mechanisms are fixed. A main frame 1 fixed to the upper surface of the housing plate 2. The shuttle printer SP further includes a power supply (not shown) and a controller (not shown).

Figure 2:
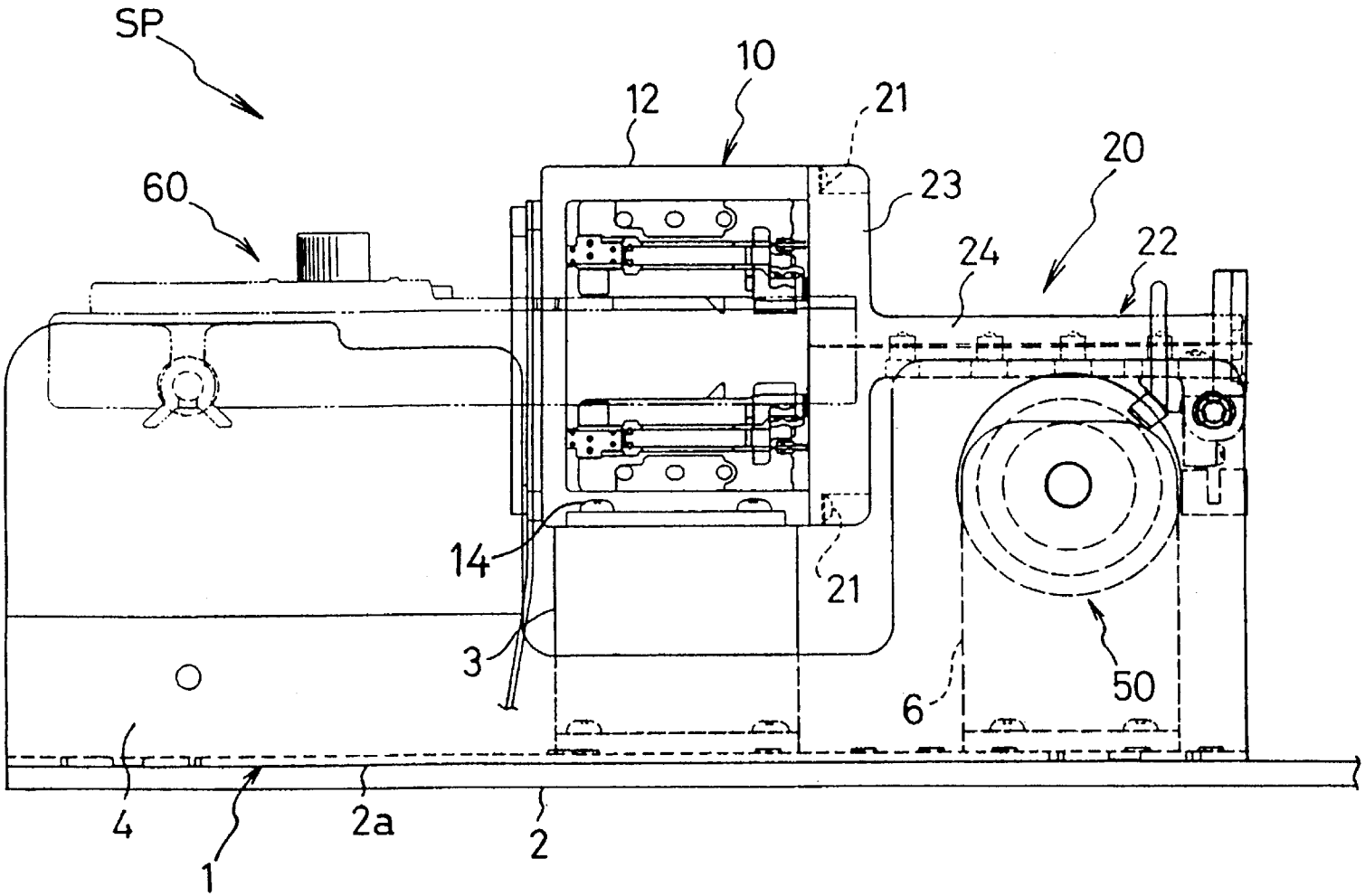
FIG. 2 is a right side view showing the principal elements of the shuttle printer except a paper feed mechanism.
Figure 3:
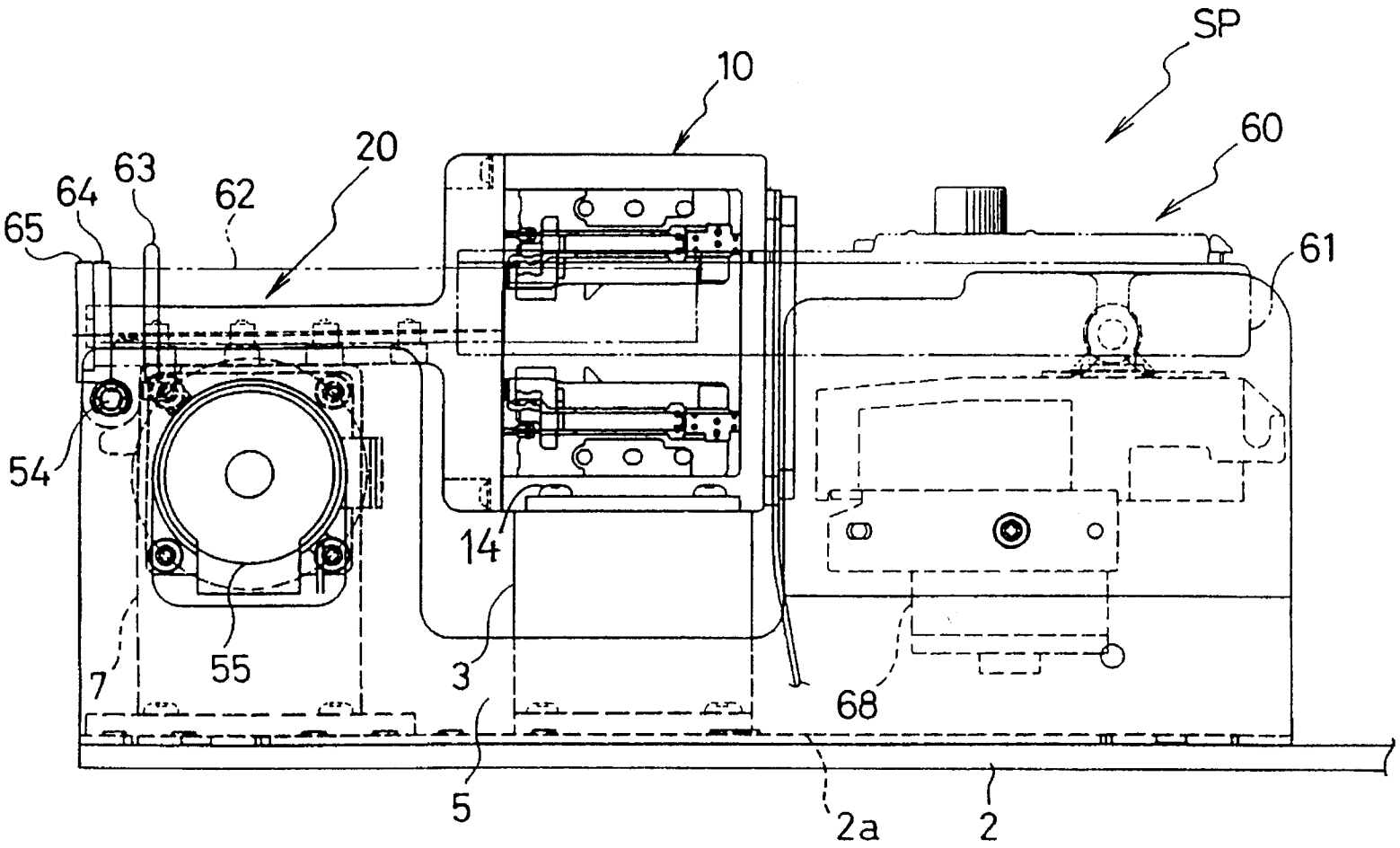
FIG. 3 is a left side view showing the principal elements of the shuttle printer except the paper feed mechanism.
Figure 5:
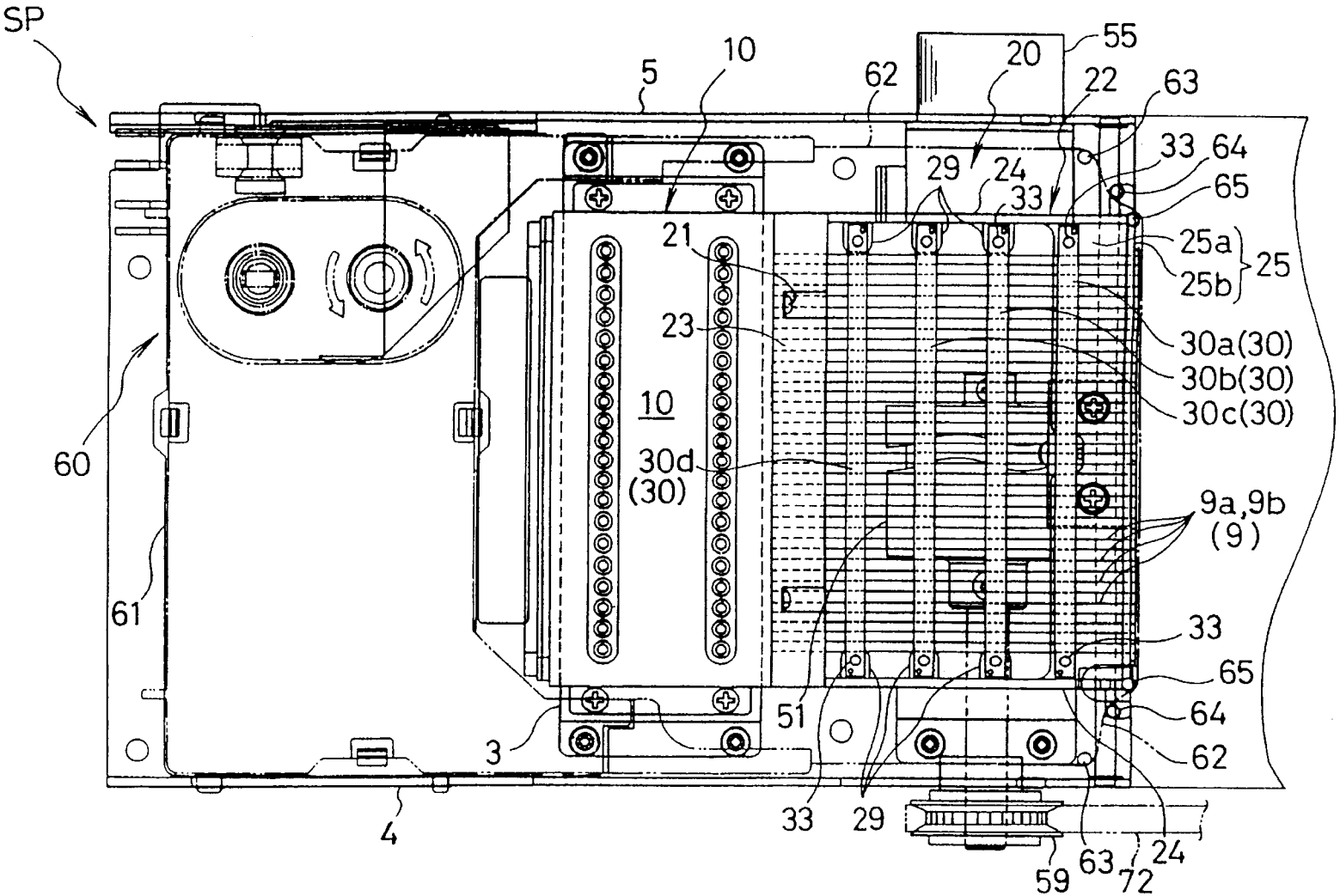
FIG. 5 is a top view of the shuttle printer except the paper feed mechanism.
Figure 6:
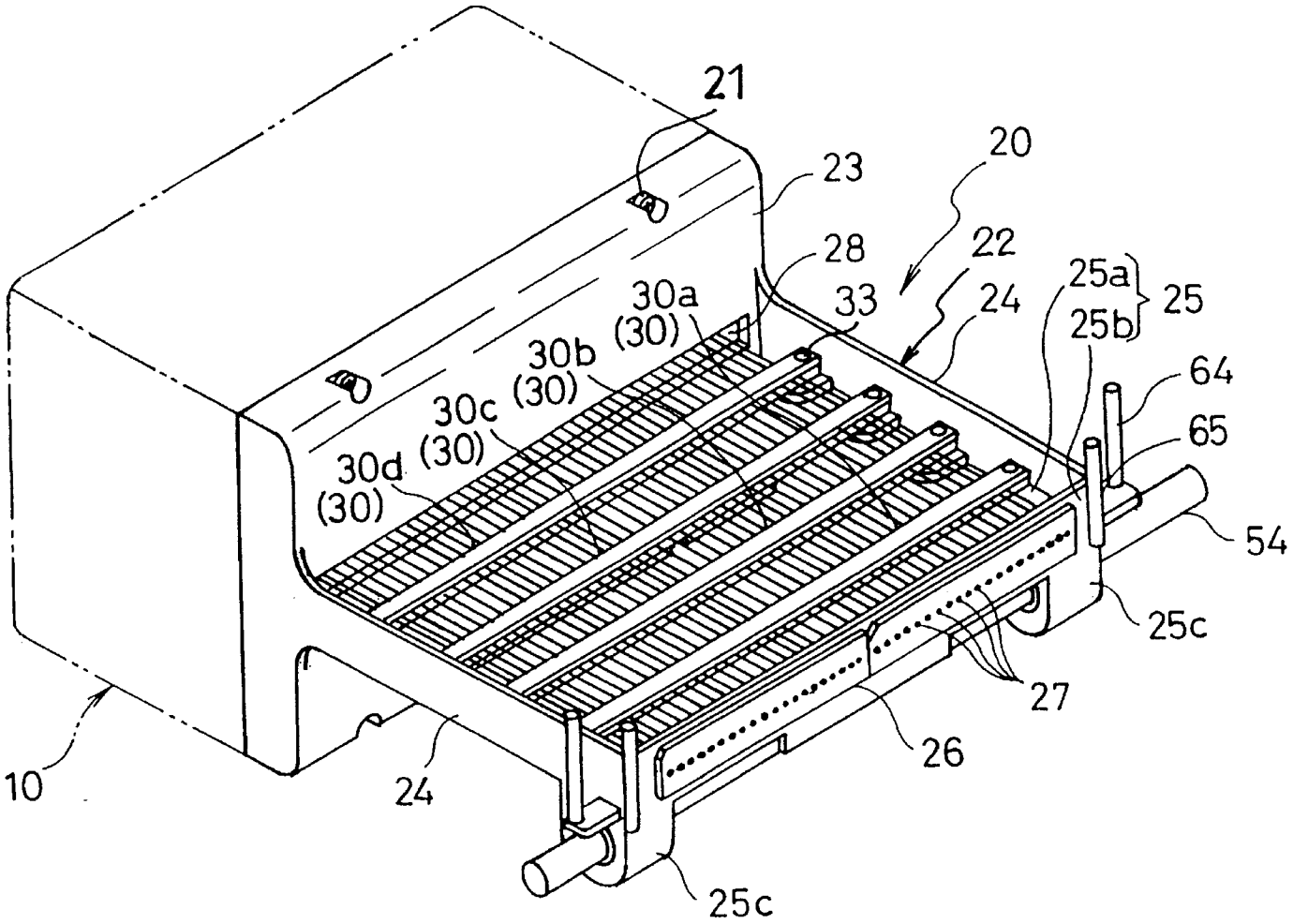
FIG. 6 is a schematic perspective view showing the print wires and the wire guide mechanism of the shuttle printer.
Figure 7:
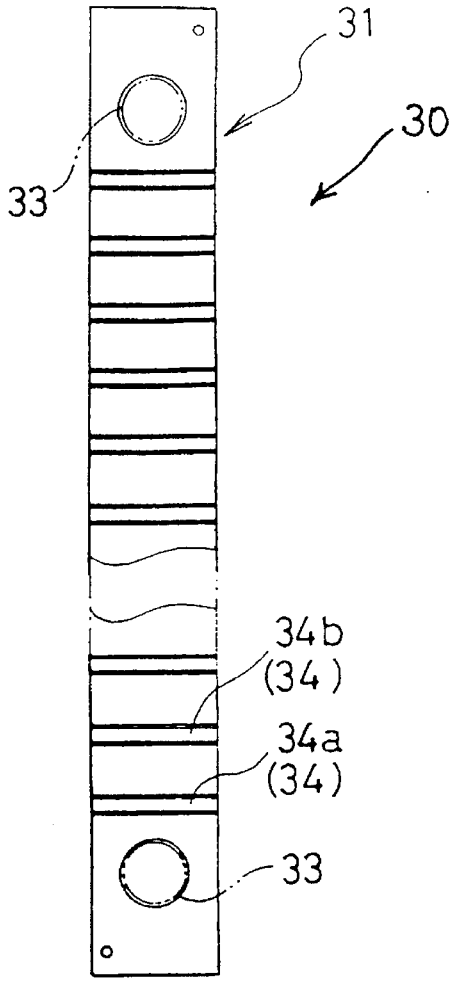
FIG. 7 is a plan view of a first guide member of a midway guide of the wire guide mechanism.

As shown in FIGS. 2, 3 and 5, the main frame 1 has a rectangular base wall 2*a*, a unit table 3 fixedly placed on the upper surface of this base wall 2*a* and on which the actuator unit 10 is mounted, a pair of right and left side walls 4 and 5, and a pair of right and left support brackets 6 and 7.

As shown in FIGS. 2 through 4, 20 piezoelectric actuators 11*a* positioned at an upper level and 19 piezoelectric actuators 11*b* positioned at a lower level are provided inside a case 12 of the actuator unit 10. The base end of each print wire 9 is attached to an output member 13 of each piezoelectric actuator 11. Each print wire 9 is driven by the piezoelectric actuator 11. The case 12 is fixed to the upper surface of the unit table 3 by a plurality of machine screws 14.

As shown in FIGS. 2 and 4 through 9, the wire guide mechanism 20 is made of a synthetic resin flexible arm 22 that is fixed to the front end surface of the case 12 of the actuator unit 10 by four machine screws 21. Four midway guides 30 (30*a* through 30*d*) are attached to the flexible arm 22.

The flexible arm 22 is composed of a box-shaped nose section 23, which is attached to the front end surface of the case 12, a pair of elastic walls 24, which horizontally extend from a middle level of the nose section 23 toward the platen in an integrated fashion, connecting wall 25, which connects the ends on a side of the platen 71 of the pair of elastic walls 24, and ceramic tip guides 26 attached to the front end of the connecting wall 25. The connecting wall 25 has an L-shaped cross section including a horizontal wall 25*a* and a vertical wall 25*b*. The tip guides 26 are attached to the end surfaces of the vertical wall 25*b*. Tip guide holes 27 are formed in the vertical wall 25*b* and the tip guides 26. The ends of the 39 print wires 9 are respectively inserted into the tip guide holes 27. Preferably, the 39 print wires 9 protrude by about 0.1–0.2 mm from the end surface of the tip guides 26 and face the surface of a platen 71.

An elongated slit 28 is formed in the nose section 23 of the flexible arm 22 in the lateral direction thereof for insertion of the 39 print wires 9. The flexible walls 24 are formed as plates having a predetermined width in an upright direction and a thickness preferably in the range of approximately 1.5–2.0 mm so that they will be elastically deformed in the lateral direction (that is, the lengthwise direction of the platen 71). Three attachment sections 29 are integrally formed at positions on the inner surface of each of the elastic walls 24 to attach three of the four midway guides 30*b* through 30*d*, preferably at approximately 10 mm intervals. A pair of rod-like ribbon guides 64 and 65 are integrally formed at the ends of the elastic walls 24 to guide a printer ribbon 62.

As for the print wires 9 extending from the output members 13 of the piezoelectric actuators 11, the 39 print wires 9 are arranged to extend substantially horizontally toward the platen 71 from each corresponding output member 13 in a direction orthogonal to the lengthwise direction of the platen 71 (forward and backward). The print wires 9 are positioned at predetermined intervals in parallel with each other in the horizontal direction.

Figure 4:
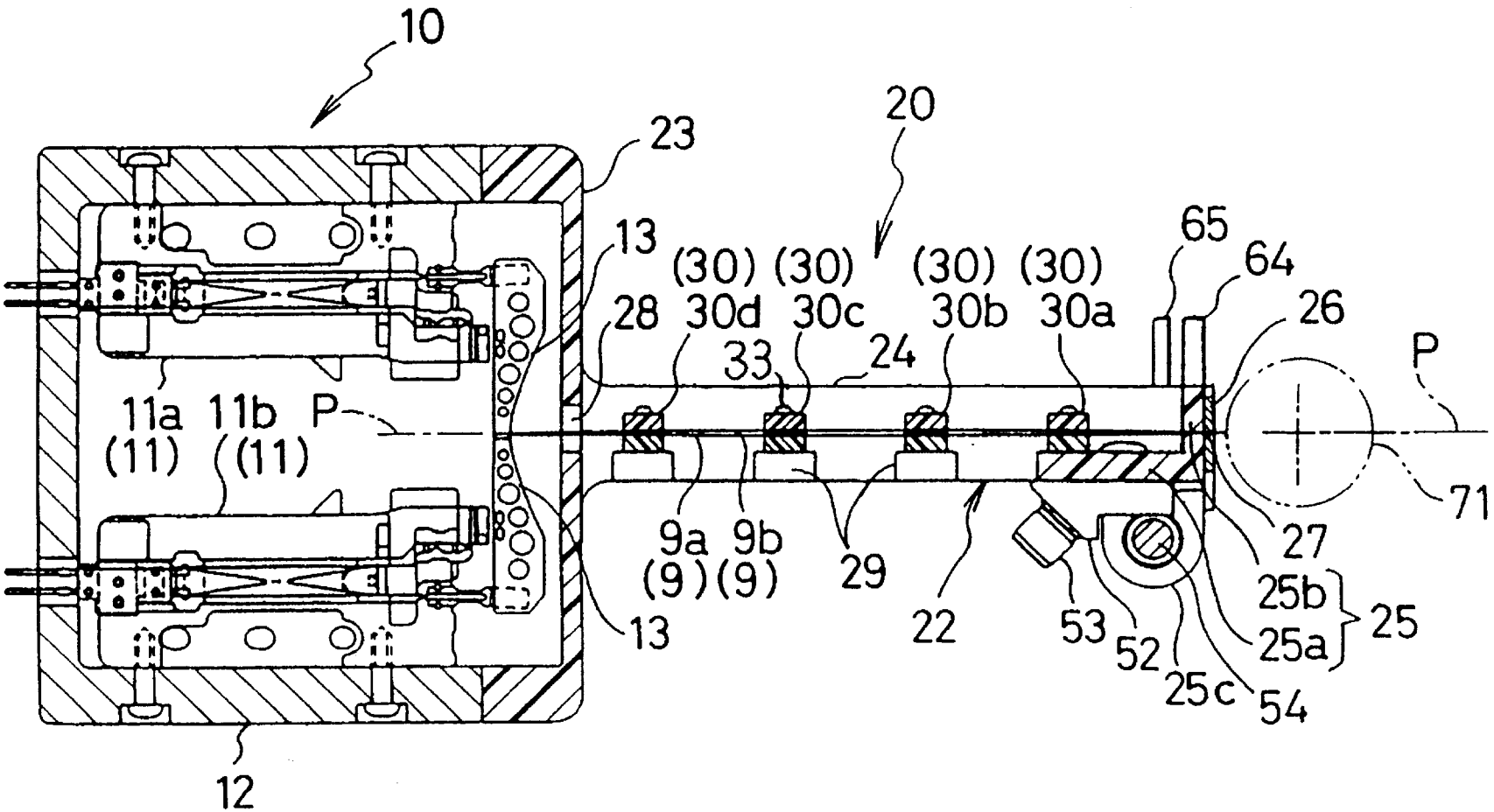
FIG. 4 is a longitudinal side view in section showing an actuator unit, print wires and a wire guide mechanism.

The print wires 9*a* extending from the output members 13 of the upper side piezoelectric actuators 11*a* and the print wires 9*b* extending from the output members 13 of the lower side piezoelectric actuators 11*b* are arranged substantially in parallel with each other in between the pair of elastic walls 24. However, as seen in FIG. 4, strictly speaking, the print wires 9*a* and 9*b* intersect each other at the base side thereof. If the surface including this point of intersection and the plurality of tip guide holes 27 is defined as a standard horizontal plane P, the print wires 9*a* extend toward the end portions thereof along the standard horizontal plane P while being very slightly curved toward the lower side of the standard horizontal plane P. On the other hand, the print wires 9*b* extend toward the end portions thereof along the standard horizontal plane P while being very slightly curved toward the upper side of the standard horizontal plane P. Thus, the print wires 9 are guided to the tip guide holes 27.

The four midway guides 30*a* through 30*d* function to support and guide the intermediate portions of the 39 print wires 9 in between the two elastic walls 24 in the lateral direction and at predetermined intervals (preferably approximately 10 mm) between them forward and backward. Each midway guide 30 is formed of a synthetic resin and has a thickness forward and backward in the range of preferably approximately 3–5 mm. The first midway guide 30*a*, nearest to the front side, is arranged on the upper surface of the horizontal wall 25*a*, and both ends thereof are respectively attached to the horizontal wall 25*a* so as to be rotatable using upright support pins 33. Both ends of the second midway guide 30*b* are respectively attached to the attachment sections 29 of the right and left elastic walls 24 so as to be rotatable using the upright support pins 33. Both ends of the third midway guide 30*c* are respectively attached to the attachment sections 29 of the right and left elastic walls 24 so as to be rotatable using the upright support pins 33. The right and left ends of the fourth midway guide 30*d* are respectively attached to the attachment sections 29 of the right and left elastic walls 24 so as to be rotatable using the upright support pins 33.

As shown in FIGS. 6 through 9, the first midway guide 30*a* includes a first guide member 31 positioned below the 39 print wires 9, and a second guide member 32 positioned above the 39 print wires and arranged so as to come into contact with the first guide member 31 to sandwich print wires 9 therebetween.

Figure 8:
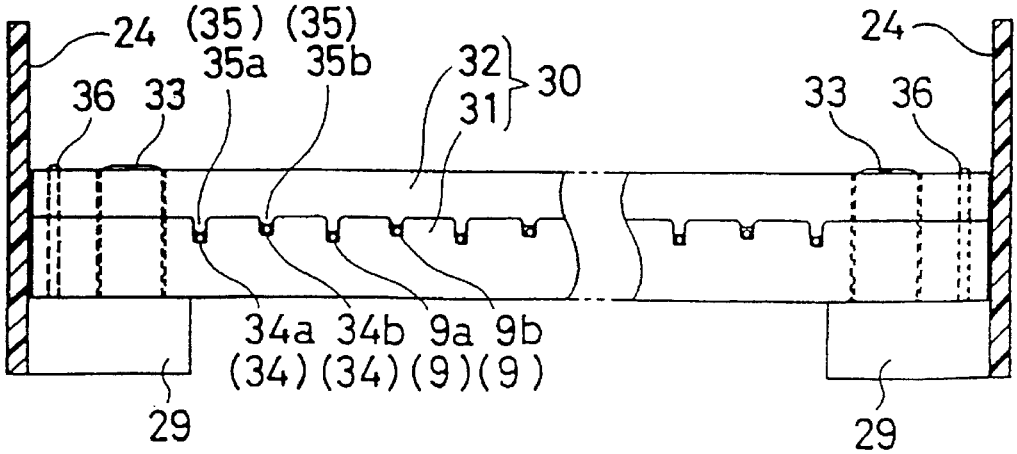
FIG. 8 is a longitudinal front view showing resilient arms and the midway guide of the wire guide mechanism.
Figure 9:
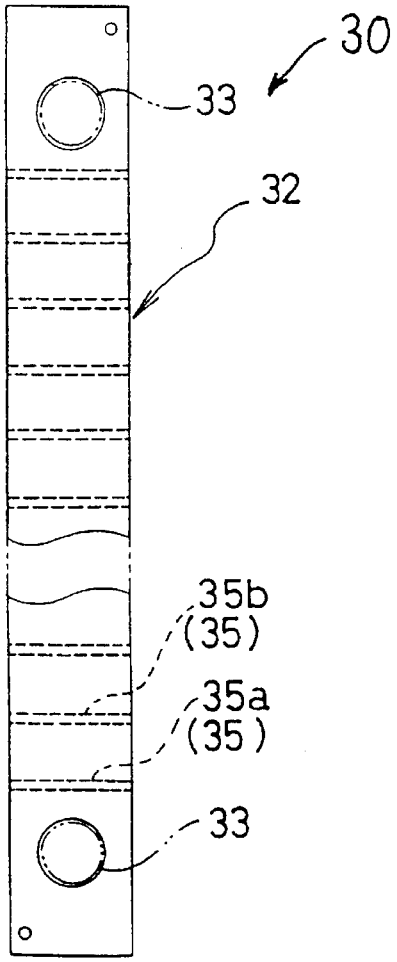
FIG. 9 is a plan view of a second guide member of the midway guide of the wire guide mechanism.

As seen in FIG. 8, 39 transverse guide channels 34 to respectively guide and support the 39 print wires 9 are formed at predetermined intervals on the upper surface of the first guide member 31. The 39 guide channels 34 include 20 guide channels 34*a* that guide the 20 print wires 9*a* connected to the upper piezoelectric actuators 11*a* and 19 guide channels 34*b* that guide the 19 print wires 9*b* connected to the lower piezoelectric actuators 11*b*.

The 20 guide channels 34*a* and the 19 guide channels 34*b* are alternately arranged. The guide channels 34*a* are formed deeper than the standard horizontal plane P, whereas the guide channels 34*b* are formed shallower than the standard horizontal plane P to accommodate the lower and upper print wires 9*a* and 9*b*, respectively.

Figure 10:
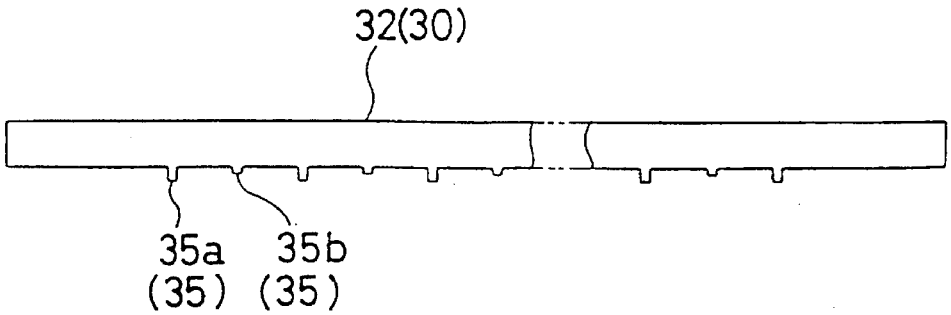
FIG. 10 is a front view of the second guide member of the midway guide of the wire guide mechanism.
Figure 11:
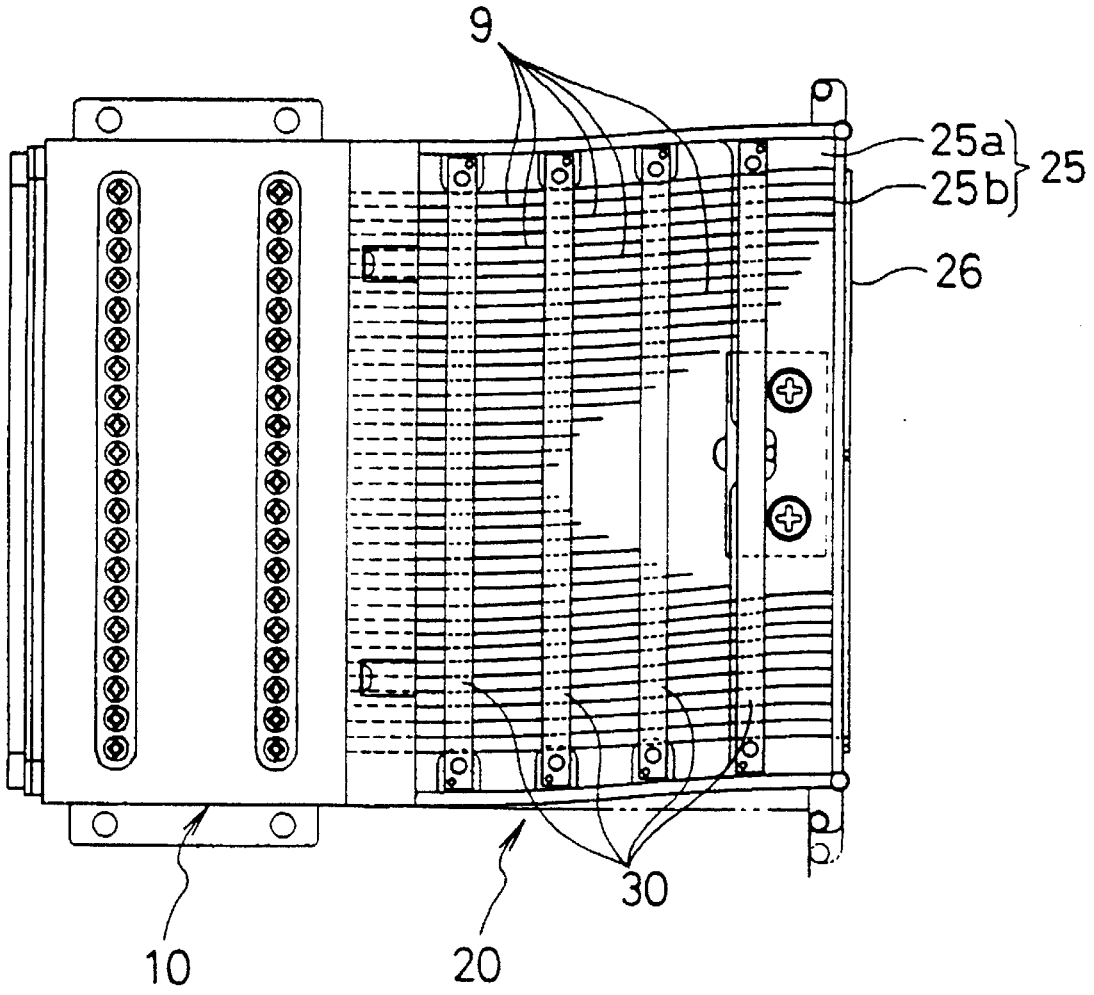
FIG. 11 is a top view of the wire guide mechanism when the actuator unit, the print wires and the resilient arms are elastically deformed.
Figure 12:
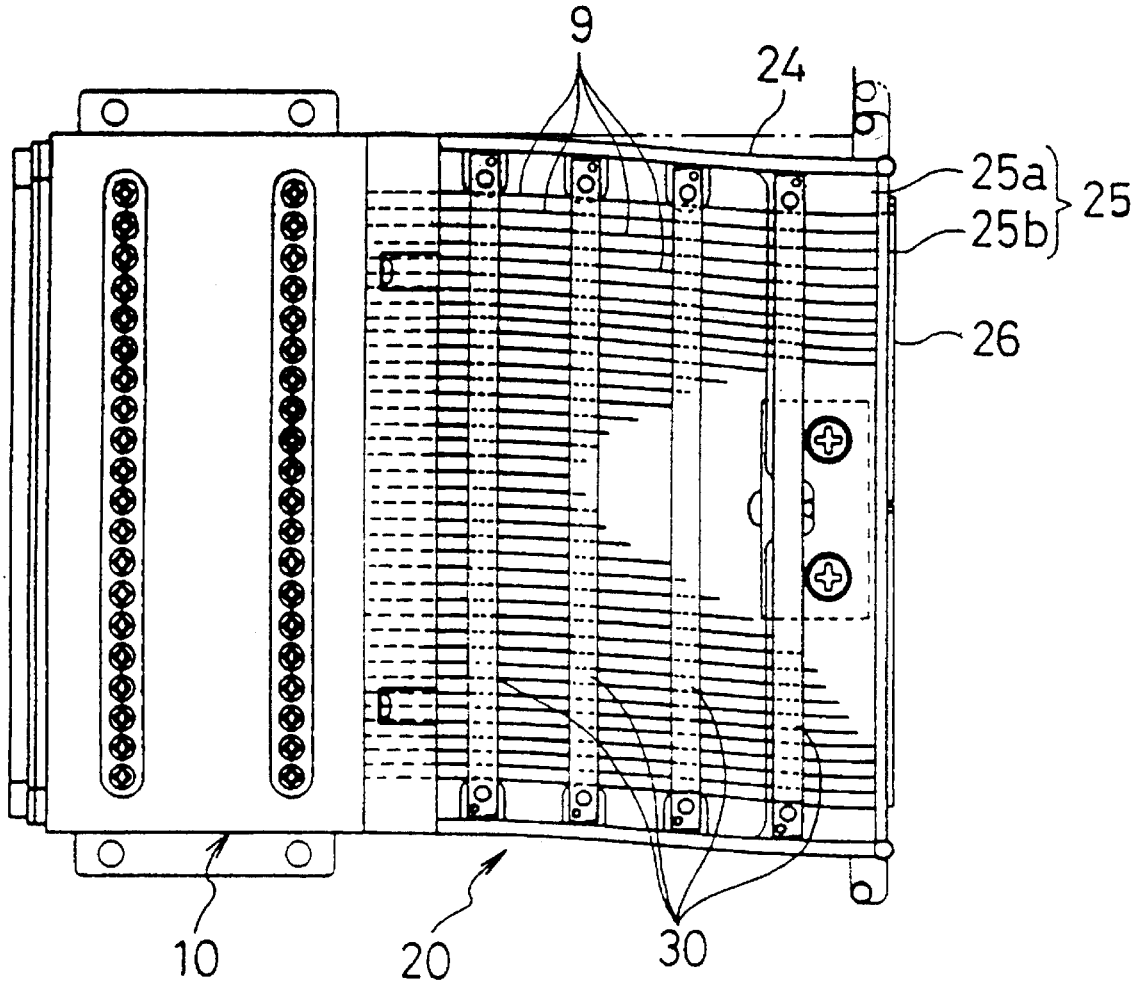
FIG. 12 is a top view of the wire guide mechanism when the actuator unit, the print wires and the resilient arms are elastically deformed.

As seen in FIG. 10, 39 engagement sections 35 are formed on the lower surface of the second guide members 32. The engagement sections 35 respectively fit into the 39 guide channels 34 while the print wires 9 are sandwiched therebetween. The 39 engagement sections 35 include 20 engagement portions 35*a* that respectively fit into the 20 guide channels 34*a* and 19 engagement portions 35*b* that respectively fit into the 19 guide channels 34*b*. Engagement portions 35*a* and 35*b* are alternately arranged and project at different heights respectively to correspond to guide channels 34*a* and 34*b*.

While the print wires 9*a* and 9*b* are slidably inserted into the guide channels 34*a* and 34*b* of the first guide channel 31, the engagement portions 35*a* and 35*b* of the second guide members 32 are fit into the guide channels 34*a* and 34*b* of the first guide member 31, and the lower surface of the second guide member 32 is brought into contact with the upper surface of the first guide member 31. In this way, the first guide member 31 and the second guide member 32 are integrally connected. Further, the insertion of connecting pins 36 shown in FIG. 8 into the right and left ends of the first guide member 31 and second guide member 32, respectively, reinforces the connection between the first guide member 31 and the second guide member 32. However, the connecting pins 36 can be omitted.

When the four midway guides 30 are attached to the printer SP, the first guide members 31 of the four midway guides 30 are initially attached to the pair of right and left support pins 33. The 39 print wires 9 are then arranged to be inserted into the guide channels 34 of the four first guide members 31, and the tip ends of the print wires 9 are respectively inserted into the holes formed in the vertical wall 25*b* of the connecting wall 25. The corresponding second guide members 32 are respectively attached to the four first guide members 31 and the right and left support pins 33. In order to adhere the tip guides 26 to the vertical wall 25*b* of the connecting wall 25, the tip ends of the 39 print wires are inserted into the 39 guide holes 27 formed in the tip guides 26, and the tip guides 26 are bonded to the vertical wall 25*b* using an adhesive.

Figure 13:
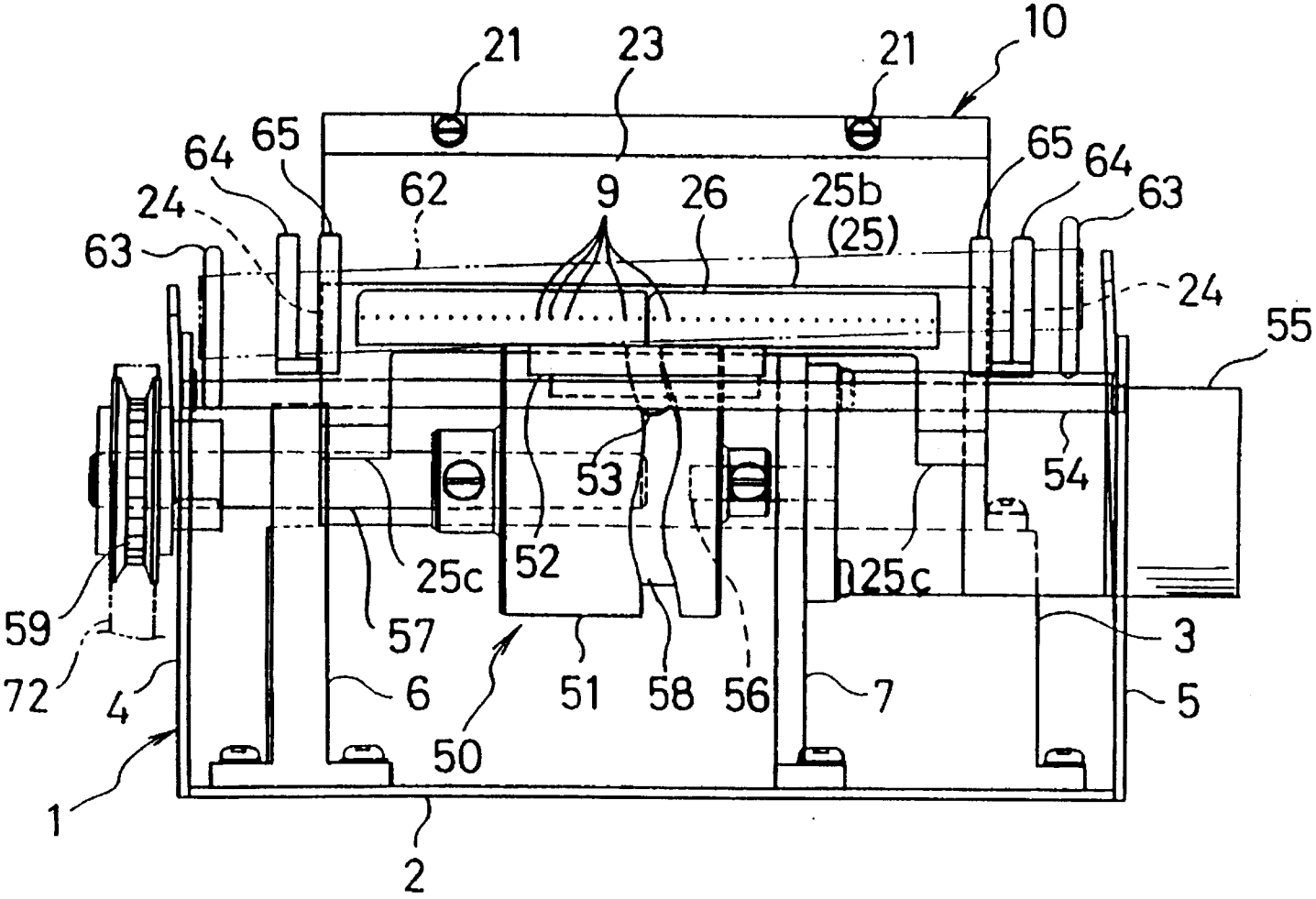
FIG. 13 is a plan view of the shuttle printer showing a swing drive mechanism and the wire guide mechanism.
Figure 14:
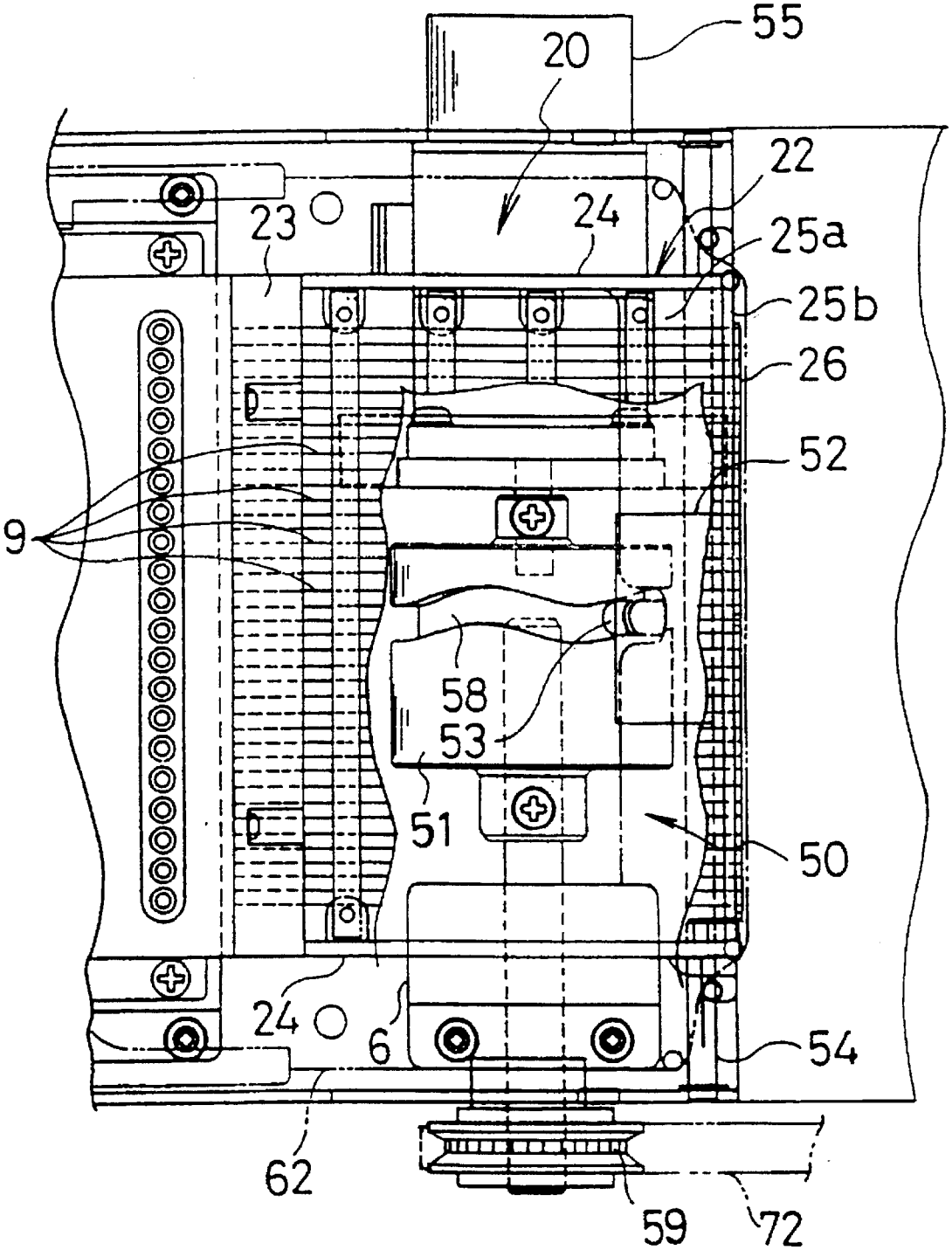
FIG. 14 is a partial plan view showing the print wires, the wire guide mechanism and the swing drive mechanism.

As illustrated in FIGS. 13 and 14, to reciprocate the 39 print wires 9 by a predetermined horizontal stroke in the lateral direction, the reciprocating mechanism 50 is provided to reciprocate the connecting wall 25 and the tip guides 26 of the flexible arm 22 by the predetermined stroke in the lateral direction.

The reciprocating mechanism 50 comprises a cam 51, an attachment member 52 fixed to the lower surface of the connecting wall 25, and a cam follower 53 consisting of a small diameter roller projecting from the attachment member 52. A guide shaft 54, which is inserted into a pair of right and left brackets 25*c* respectively protruding downward at the right and left ends of the connecting wall 25, guides the connecting wall 25 in a lateral direction. A DC motor 55 rotatably drives the cam 51.

The cam 51 is preferably made of metal and is formed into a substantially columnar shape with its axis facing in the lateral direction. The cam 51 is arranged at the lower central part of the flexible arm 22. The DC motor 55 is installed on one side wall 5 and the shaft support bracket 7. An output shaft 56 of this motor 55 is supported by the shaft support bracket 7. The output shaft 56 is fixedly attached to and supports the axial center of one end of the cam 51. A shaft member 57 connected to the axial center of the other end of the cam 51 is supported by the shaft support bracket 6.

The outer peripheral surface of the cam 51 is formed as a cam channel 58 having a sine curve shape, and the cam follower 53 is slidably inserted into the cam channel 58. With one rotation of the cam 51, the cam follower 53, and the connecting wall 25 and the tip guides 26 coupled thereto, undergo three lateral reciprocal swings.

The attachment member 52 is preferably made of metal and is fixed to the lower surface of the horizontal wall 25*a* of the connecting wall 25 by machine screws. The guide shaft 54, which guides the connecting wall 25, is arranged horizontally in the lateral direction, and both ends of the guide shaft 54 are supported by pivot holes in the right and left side walls 4 and 5.

A timing pulley 59 is joined to the end of the shaft member 57. Drive power is transmitted to a reduction gear mechanism 73 shown in FIG. 15 that intermittently drives a drive roller 77 through a timing belt 72 engaged around the pulley 59.

As shown in FIGS. 1, 3 and 5, a cassette housing 60 for housing the ribbon cassette 61 is provided on the opposite side of the platen 71 with respect to the actuator unit 10. The print ribbon 62 supplied from a supply reel of the ribbon cassette 61 passes through ribbon guides 63 extending from side walls 4 and 5 and ribbon guides 64 and 65 on both right and left ends of the connecting wall 25 and is taken up by a take-up reel of the ribbon cassette 61. A ribbon supply motor 68 shown in FIG. 3 is supplied in a upright manner at the lower side of the cassette housing 60. The take-up reel is driven for take-up by the ribbon supply motor 68.

Figure 15:
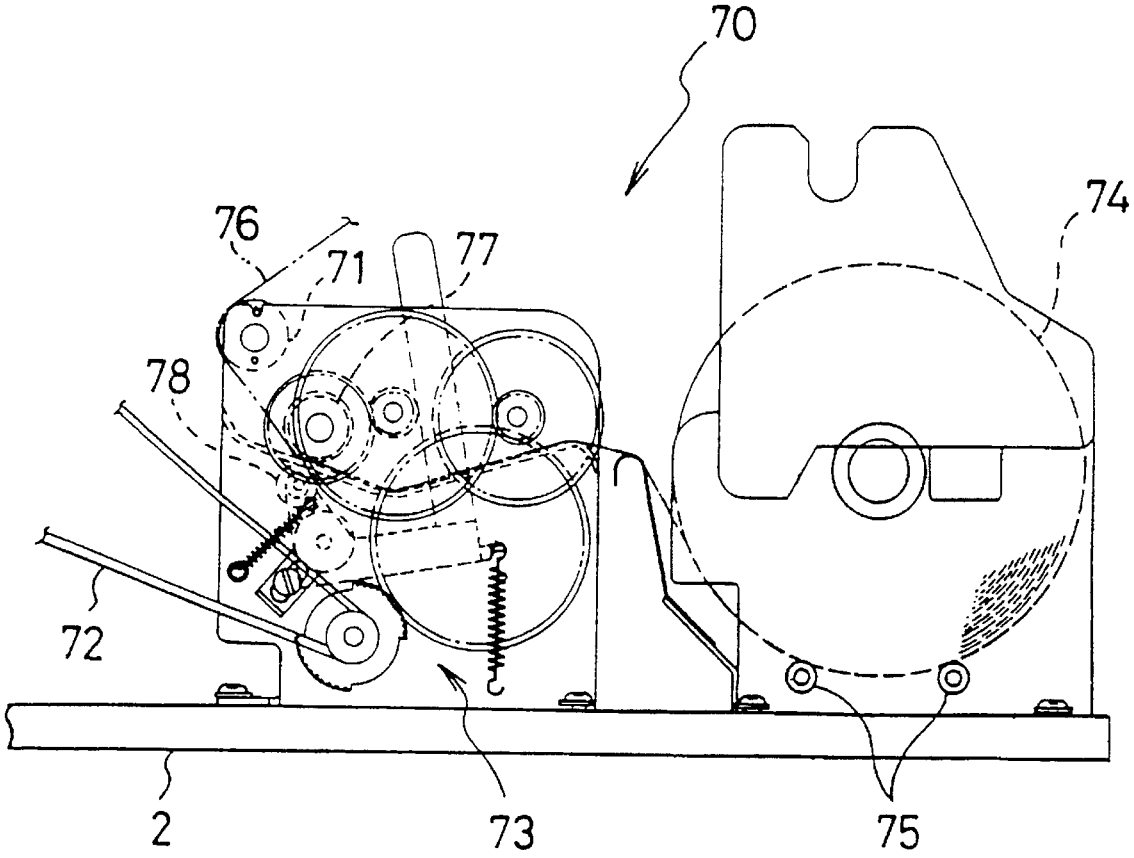
FIG. 15 is a schematic side view of the paper feed mechanism of the shuttle printer.

The paper feed mechanism 70 is depicted in FIG. 15. A print paper roll 74 is placed on a pair of idle roller shafts 75, and print paper 76 extending from the print paper roll 74 passes between a supply drive roller 77 and a supply pinch roller 78 to be supplied between the platen 71 and the tip guides 26. Finally, after being printed by the 39 print wires 9, the paper 76 is discharged upward. A keyboard (not shown) is provided with various keys and switches for inputting alphabetical characters and symbols, Japanese characters and symbols, and various commands.

The controller is provided to control the 39 piezoelectric actuators 11 of the actuator unit 10, the DC motor 55 and the ribbon supply motor 68. The controller controls the object actuators in accordance with data input by the keyboard and various commands, through the use of a previously stored print control program.

In operation, when printing is carried out using the 39 print wires 9, the 39 piezoelectric actuators 11 are selectively driven together with the driving of the DC motor 55 of the reciprocating mechanism 50. Accordingly, the tip guides 26 and the connecting wall 25 at the ends of the flexible arm 22 are driven to reciprocally swing in the lateral direction. As a result of this operation, a unit of 6 dots is selectively printed in the line direction (lateral direction) by each print wire 9. In case of alphabetical characters, each character is printed in a dot pattern that has five dots in the line direction and seven dots in the line feed direction, with a one dot space between characters and a three dot space between lines. In this shuttle printer SP, the diameter of the print wire 9 is 0.3 mm.

The tip guides 26 and the connecting wall 25 at the ends of the flexible arm 22 are driven to reciprocally swing in the lateral direction by the swinging drive mechanism 50. At this time, the pair of elastic walls 24 of the flexible arm 22 are gently elastically deformed. Hence, the tip guides 26 reciprocally swing according to the required characteristic (see FIGS. 11 and 12).

The four midway guides 30 are provided on the flexible arm 22 and guide and support the intermediate portions of the 39 print wires 9 at predetermined intervals. Thus, deformation of the print wires 9 in the direction orthogonal to the reference plane P can be reliably prevented. It becomes possible to ensure accurate, clear printing by transmitting print drive force from the piezoelectric actuator 11 to the tip end of the print wire 9 without substantial loss of the force. In addition, the deformation of the print wires 9 is prevented, and the distortion and stress developed in the print wires 9 can be reduced. So, breakage of the print wires 9 can be prevented, and the durability of the print wires 9 can be improved.

Further, the midway guides 30 are made of a synthetic resin having small frictional resistance. Also, the thickness of the midway guides 30 in the longitudinal direction thereof is small. Hence, friction between the midway guides 30 and the print wires 9 becomes very small.

Both ends of each midway guide 30 are pivotally attached to the flexible arm 22 using the pivot support pins 33, which are orthogonal to the swinging plane of the tip guides 26. So, there is no side pressure on the print wires 9, and the midway guides 30 never resist the reciprocal swinging of the tip guides 26.

As described above, each midway guide 30 consists of the lower first guide member 31 and the upper second guide member 32 that comes into contact with the upper surface of this first guide member 31. While the 39 print wires 9 are respectively inserted into the 39 guide channels 34 of the first guide member 31, the 39 engagement sections 35 of the second guide members 32 respectively fit into the guide channels 34. Therefore, it is possible to reliably guide and support the 39 print wires at predetermined intervals in the lateral direction. Further, the assembly of the midway guides 30 and the print wires 9 is not made complicated.

Although the invention has been described with reference to the above embodiment, various modifications may be made to parts of this embodiment, and some of them are described below.

1) At least the pair of right and left elastic walls 24 of the flexible arm 22 may be made of stainless steel or steels. In this case, the base ends of the elastic walls 24 can be fixed to the nose section 23 by machine screws. Moreover, the connecting wall 25 and the pair of elastic wall members can be integrally formed as a single metal part.

2) As the structure for connecting both ends of the midway guides 30 to the pair of elastic walls 24, any of various connecting structures other than the pivotal pins 33 is practicable for connecting both ends of the midway guides 30 to be rotatable on the axis orthogonal to the swinging surface of the tip guides 26.

3) The plurality of midway guides 30 is not limited to four, so long as, depending on the length of the print wires 9 between the tip guides 26 and the nose section 23, at least one midway guide is suitably provided. However, when the diameter of the print wires is less than 0.3 mm, it is preferable that the interval between any two midway guides is no greater than 10 mm. Here, the larger the diameter of the print wires 9 is, the larger the interval between midway guides 30 will be.

4) The plurality of print wires 9 is not limited to 39, and the plurality of wires can vary, i.e. several, several tens, or several hundreds of wires can be provided, according to the application of the shuttle printer SP. Moreover, the print wires 9 and the wire guide mechanism 20 are not always arranged in a horizontal plane, but they can be inclined to the horizontal plane.

5) In the reciprocating mechanism 50, instead of the recessed shape of the cam groove 58, the cam groove 58 can be formed as a pair of integrally projecting flange wall sections. In place of the cam type reciprocating mechanism 50 using the cam 51, a crank type reciprocating mechanism, or a mechanism in which lateral movement is effected by an electromagnetic actuator, can be suitably employed.

According to the shuttle printer of the first aspect of the present invention, as already been explained, the shuttle printer of this invention comprises a flexible arm having an end member to which the end guide is attached and a pair of right and left resilient members and the midway guides. The plurality of print wires are guided and supported by the midway guides in between the tip guides and the plurality of actuators. Hence, the elastic deformation of the plurality of print wires in the direction orthogonal to the length of the print wires can be effectively suppressed. Moreover, the absorption of the drive power for operating the print wires from the actuators can be prevented. Hence, both print quality and the durability of the print wires can be improved.

According to the shuttle printer of the second aspect of this invention, the plurality of midway guides can further enhance the same effects as those obtained by the shuttle printer of the first aspect.

According to the shuttle printer of the third aspect of this invention, each midway guide includes a first guide member and a second guide member. Hence, the assembly of the midway guides can be simplified.

What is claimed is:

1. A shuttle printer comprising:

a plurality of elongated print wires laterally arranged at predetermined intervals in a reference plane, each print wire having a fixed end and a free end;

an actuator unit including a plurality of actuators, each actuator being coupled to the fixed end of a print wire to drive the print wire based on print data;

a reciprocating mechanism coupled to the plurality of print wires for swinging the print wires transversely within the reference plane; and a wire guide coupled to the actuator unit supporting the plurality of print wires during transverse movement within the reference plane, including a flexible arm extending in the reference plane having a pair of elastic side walls extending on both sides of the plurality of print wires, an end connecting member extending between the side walls and supporting the free ends of the print wires, and at least one intermediate guide rotatably secured between the side walls, wherein the intermediate guide supports the plurality of print wires between the actuators and the end connecting member.

2. The shuttle printer of claim 1 wherein the at least one intermediate guide comprises a plurality of intermediate guides spaced at predetermined intervals between the actuator unit and the end connecting member.

3. The shuttle printer of claim 1 wherein each side wall includes at least one attachment section, the attachment sections of each side wall being arranged to face and oppose each other, and each attachment section having a pivotal support thereon, wherein the at least one intermediate guide is coupled between the pivotal supports on each of the opposed attachment sections.

4. The shuttle printer of claim 3 wherein each pivotal support comprises an upright pin and the at least one intermediate guide has opposed ends with apertures therein, wherein the upright pins engage the apertures to allow the at least one intermediate guide to rotate in the reference plane.

5. The shuttle printer of claim 1 wherein the at least one intermediate guide comprises a first member and a second member joined together to sandwich the print wires therebetween.

6. The shuttle printer of claim 5 wherein at least one of the first member and the second member has a plurality of transverse guide channels therein arranged at intervals to correspond to the print wires.

7. The shuttle printer of claim 6 wherein the guide channels: have alternating depths.

8. The shuttle printer of claim 6 wherein the first member has the guide channels therein and the second member has engagement sections protruding therefrom arranged at intervals corresponding to the intervals of the guide channels, the engagement sections being arranged to mate with the guide channels and hold the print wires therebetween.

9. The shuttle printer of claim 8 wherein the guide channels have alternating depths and the engagement sections have alternating heights opposite and complementary to the guide channels.

10. The shuttle printer of claim 5 further comprising connecting pins that couple the first member and the second member together.

11. The shuttle printer of claim 1 wherein the flexible arm is formed of synthetic resin.

12. The shuttle printer of claim 1 wherein the wire guide further comprises a nose attached to the actuator unit having an elongated slit therein through which the plurality of print wires outwardly extend.

13. The shuttle printer of claim 1 wherein the end connecting member is an L-shaped member including a generally horizontal plate and a generally vertical plate, the vertical plate having an opening formation through which the free ends of the print wires extend.

14. The shuttle printer of claim 13 wherein the opening formation in the end connecting member comprises a plurality of aligned holes spaced at intervals corresponding to intervals at which the print wires are spaced.

15. The shuttle printer of claim 1 further comprising a ceramic tip guide secured to the end connecting member of the wire guide having a plurality of holes therein that receive the free ends of the print wires.

16. The shuttle printer of claim 1 wherein the plurality of actuators in the actuator unit are arranged in an upper row and a lower row offset from the upper row, with each print wire being coupled to alternating upper and lower actuators so that the print wires extend generally parallel to each other at predetermined intervals.

17. The shuttle printer of claim 1 further comprising a base member, including a base wall, a unit table supported by the base wall, and a pair of side walls extending from the base wall with support brackets thereon, wherein the unit table supports the actuator unit and the support brackets support the reciprocating mechanism.

18. The shuttle printer of claim 17 wherein the reciprocating mechanism includes a cam supported by the base member, a cam follower engaged with the cam and attached to the end connecting member of the wire guide, a driving motor secured to the base member and the cam, and a guide shaft extending laterally with respect to the wire guide supported by the end connecting member of the wire guide and by the side walls of the base member to guide the end connecting member in lateral movement upon rotation of the cam.

19. The shuttle printer of claim 18 wherein the cam is a cylinder with a longitudinal axis supported for rotation about the longitudinal axis by the driving motor and has an exterior cylindrical surface with a sinuous channel formed therein, wherein the cam follower is a roller that engages and travels in the sinuous channel.

20. A shuttle printer with a frame, plurality of print wires laterally arranged at predetermined intervals and having tip ends facing a platen, a plurality of actuators supported by said frame coupled to said print wires respectively driving said print wires, tip guides guiding and supporting said tip ends of said print wires, and a reciprocating mechanism coupled to said frame and said tip guides reciprocating said tip guides in a lateral swinging plane, comprising:

a gate-shaped flexible arm including an end member to which said tip guides are fixed, a pair of right and left resilient members fixed to said end member and to the frame extending in a direction generally parallel to said print wires at a right side and a left side of said print wires, respectively, and a midway guide laterally rotatably coupled between said right and left resilient members to guide add support said print wires such that said midway guide is rotatable on an axis orthogonal to the swinging plane in which said tip guides are laterally reciprocated.

21. The shuttle printer of claim 20, wherein a plurality of midway guides are provided at predetermined intervals in a lengthwise direction of said print wires.

22. The shuttle printer of claim 21, wherein each of said midway guides comprises a first guide member with a plurality of guide channels, each guide channel guiding one of said print wires, and a second guide member with a plurality of engagement sections, each engagement section fitting into one of said guide channels, wherein said first guide member and said second guide member are positioned to contact each other with said print wires sandwiched therebetween.

* * * * *